US007347421B2

(12) United States Patent
Ibach

(10) Patent No.: US 7,347,421 B2
(45) Date of Patent: Mar. 25, 2008

(54) CHESS SET FOR THE BLIND

(76) Inventor: James Roy Ibach, 4362 Clairemont Mesa Blvd., Apt. 56, San Diego, CA (US) 92117

( * ) Notice: Subject to any disclaimer, the term of this patent is extended or adjusted under 35 U.S.C. 154(b) by 101 days.

(21) Appl. No.: 11/282,642

(22) Filed: Nov. 21, 2005

(65) Prior Publication Data

US 2007/0114720 A1 May 24, 2007

(51) Int. Cl.
*A63F 3/00* (2006.01)

(52) U.S. Cl. ..... 273/260; 273/288

(58) Field of Classification Search ..... 273/255, 273/258, 260, 261, 262, 283, 284, 288; D21/386, D21/388

See application file for complete search history.

(56) References Cited

U.S. PATENT DOCUMENTS 3,746,343 A * 7/1973 Shapiro ..... 273/239

4,188,734 A * 2/1980 Rich ..... 434/159

OTHER PUBLICATIONS

"A Description and Image of a Braille Chess Set," http://www.brailechess.net/board.html, dated Sep. 26, 2005, pp. 1-7.

* cited by examiner

*Primary Examiner*—Vishu K. Mendiratta
(74) *Attorney, Agent, or Firm*—Birch, Stewart, Kolasch & Birch, LLP

(57) ABSTRACT

A chess set for blind players. The board includes squares having different tactile patterning to distinguish different colors. Each square contains a hole extending through the board. A border includes indicia, both visual and tactile, to indicate the file and rank. The bottom of the board includes the holes which extend from the top. The holes are connected with lines which can be felt connecting the holes in the horizontal, vertical and diagonal directions. The pieces include projections which extend through the holes and which have some indication of both the color and type of piece so that a blind player can feel possible moves on the bottom of the board by the various pieces.

21 Claims, 4 Drawing Sheets

CHESS SET FOR THE BLIND

BACKGROUND OF THE INVENTION

1. Field of the Invention

This invention relates generally to a chess set and more particularly to a chess set which is designed for blind players.

2. Description of the Background

The game of chess has been played for centuries and is internationally known and played by millions of enthusiasts. Among the players are many people who are blind. In fact, there is even an international organization called the Braille Chess Association which organizes tournaments and provides materials for blind and partially sighted people.

Since blind players cannot, at a glance, observe the locations of the pieces, it is necessary to provide some modifications to the board and rules so that the blind player can remember the relative locations of the pieces and can visualize possible moves.

One such arrangement includes a board where the squares of one color are either sunken below the surface of the board or raised from the surface of the board. Each square contains a hole in its center. Each piece has a peg or pin on its bottom which fits into the hole so that the pieces are not easily knocked over while the blind player feels the position of the pieces. Each piece must have a shape which clearly identifies the piece by feel. Many standard chess sets provide enough detail for identifying the pieces by feel, but one of the teams (white or black) must have an identifying mark, such as a protruding centrally located pin which is easily feelable.

When playing with one or more blind players, it is common to use two boards so that each player can study the board by hand without hindering the opponent's similar study. When a move is made, it must be announced using standard chess notation for the ranks and files (rows and columns) on the chessboard and each player must be responsible for moving the pieces of both sides on his board when they are announced.

While the prior art devices allow blind players to play chess, it would be helpful to have additional means for visualizing the arrangement of the pieces on the board and to more easily feel the relative positions of the pieces in the horizontal, vertical and diagonal directions.

SUMMARY OF THE INVENTION

Accordingly, the present invention is designed to provide an improved Braille chess set.

The present invention also is designed to provide a chess set usable by both sighted and blind players.

The present invention further provides a chess set having improved indicia for allowing the player to determine the relative possible movements of the pieces in various directions.

The present invention further provides a chessboard having tactile indicia connecting the centers of the various squares along the horizontal, vertical and diagonal directions.

The present invention still further provides a chess set having protrusions extending from each piece which extend through the board and which contain tactile indicia for identifying each piece.

The present invention still further provides an improved Braille chess set having tactile indicia indicating directions of movement connecting the various squares and including indicators on the pieces for identifying each piece.

Briefly, the invention achieves this by providing a chessboard with holes extending through the board in the center of each square and with tactile lines being drawn between the holes in the horizontal, vertical and diagonal directions. The chess pieces have protrusions which extend through the hole and which contain indicia on the protrusion for identifying each piece.

BRIEF DESCRIPTION OF THE DRAWINGS

A more complete appreciation of the of the invention and many of the attendant advantages thereof will be readily appreciated as the same becomes better understood by reference to the following detailed description when considered in connection with the accompanying drawings, wherein.

DESCRIPTION OF THE PREFERRED EMBODIMENTS

Figure 1:
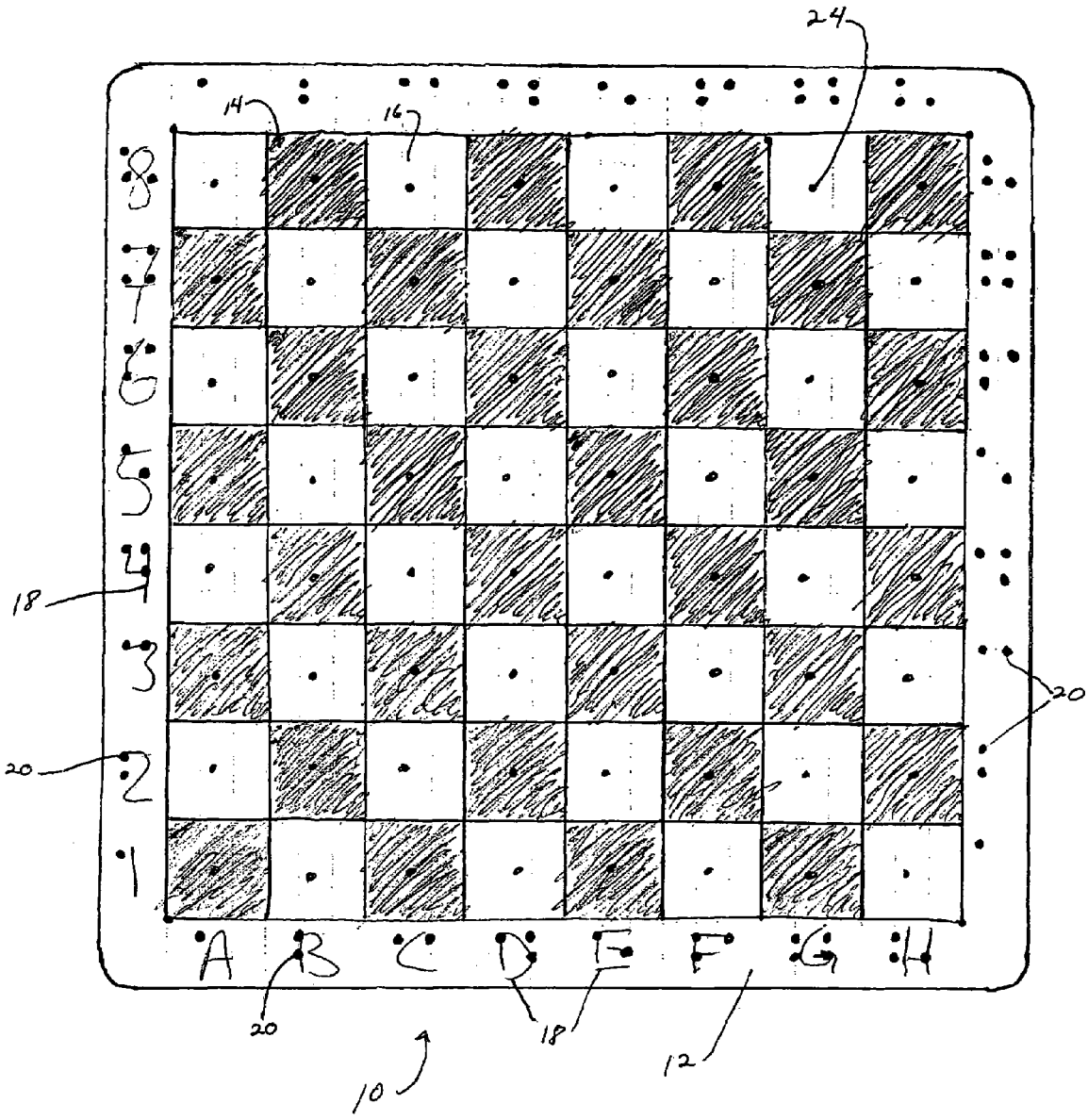
FIG. 1 is a top view of a chessboard used with the present invention.

Referring now to the drawings, wherein like reference characters designate identical or corresponding parts throughout the various views, and more particularly, to FIG. 1, where the overall arrangement of the top of the chessboard of 10 is shown. The board has a border 12 around its outer periphery. Inside the border is a standard arrangement of 64 equally sized squares alternating between black squares 14 and white squares 16. Each square contains a centrally located hole 24 for receiving a projection of a chess piece. Either the black square or the white squares, but not both, contain a tactile feature for identifying their color. This can be, for example, a different texture, such as a buff texture or a grooved texture or any other texture which is easily distinguishable from a non-textured surface, representing the other color. Alternatively, both colors can have a texture which are different from each other.

The border contains indicia, both visual and other indicia which are identified by feel such as Braille, to indicate the rank and file designations. Thus, letters A-H are placed along the end of the board closest to the player and the numbers 1-8 extend along at least one side of the board. Corresponding Braille notations are also present for use by non-sighted players. The indicia can be present on all four sides, or only on two sides, as desired. If the set is designed for use by a single player (with a matching board for his opponent), the indicia should be arranged so that it is oriented to the position of the single player. If the board is designed for use by both players at the same time, half of the indicia can be reversed for the convenience of the other player.

The visually observed indicia are indicated by reference numeral 18. The Braille or other tactile indicia are indicated by reference numeral 20.

Figure 2:
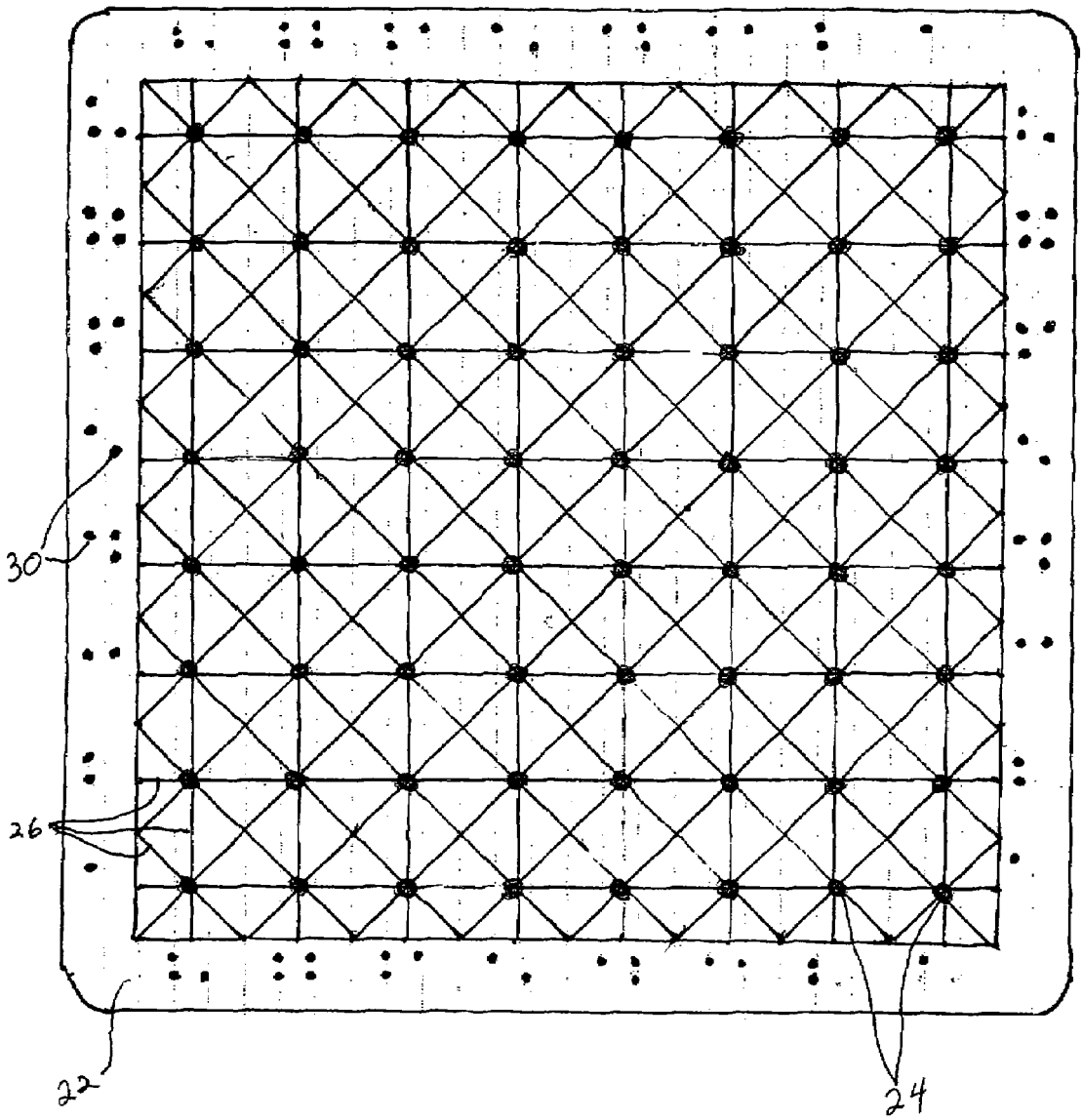
FIG. 2 is a bottom view of a chessboard used in the present invention.

FIG. 2 shows the bottom side of the chessboard 10. The bottom also has a similar size border 22. The border contains the Braille or other tactile indicia 30, for the rank and file indicators. Sixty-four holes 24 extend through the surface, and are extensions of the holes on the top surface at the center of each square. Thus, the sixty-four holes are arranged in an 8×8 pattern. The holes are joined by lines 26 extending in the horizontal, vertical and diagonal directions, which are the main directions of movement of the chess pieces. The lines are easily identified by touch and may be lines formed by projections or may be grooves cut into the board. Although the lines are shown as extending all the way to the edge of the border, these may be removed between the border and the adjoining line of holes since movement beyond the squares adjoining the border is not possible.

It should be noted that the visual indicia is not provided on the bottom of the board since it is not visible, while it is possible to feel the location using the tactile indicia, without turning the board over.

Figure 3:
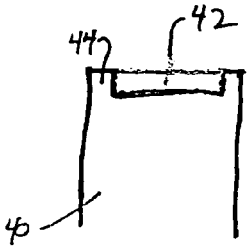
FIGS. 3-11 show various designs for the individual chess pieces used in the present invention.
Figure 4:
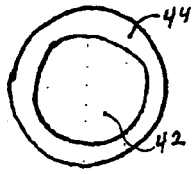
Figure 5:
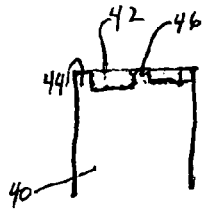
Figure 6:
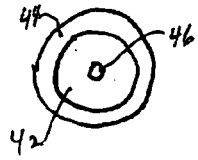

FIGS. 3-11 show the arrangement of indicia on the bottom of the protrusions of the various chess pieces. FIG. 3 shows a cross-sectional view of the bottom of a pawn. FIG. 4 is a bottom view of the same piece. As can be seen, a central depression 42 is formed at the end of the protrusion 40. The depression 42 is contained within a ridge 44 which extends completely around the protrusion to indicate that this is a pawn. FIG. 5 shows a similar cross-sectional view of a pawn of the opposite color. A pin 46 is present to indicate the color of this piece. This will correspond also to the additional pin which is provided on the top surface of the various pieces. By using this arrangement, it is possible for a player to feel the bottom of the protrusion to detect the color of the piece and the type of piece.

Figure 7:
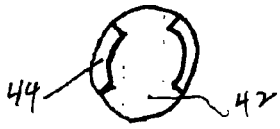
Figure 8:
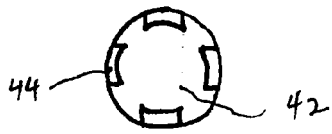
Figure 9:
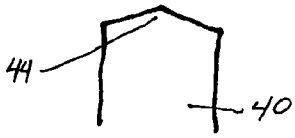
Figure 10:
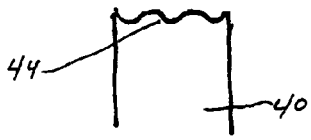
Figure 11:
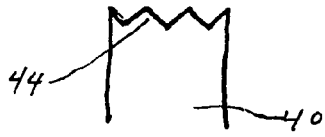
Figure 12:
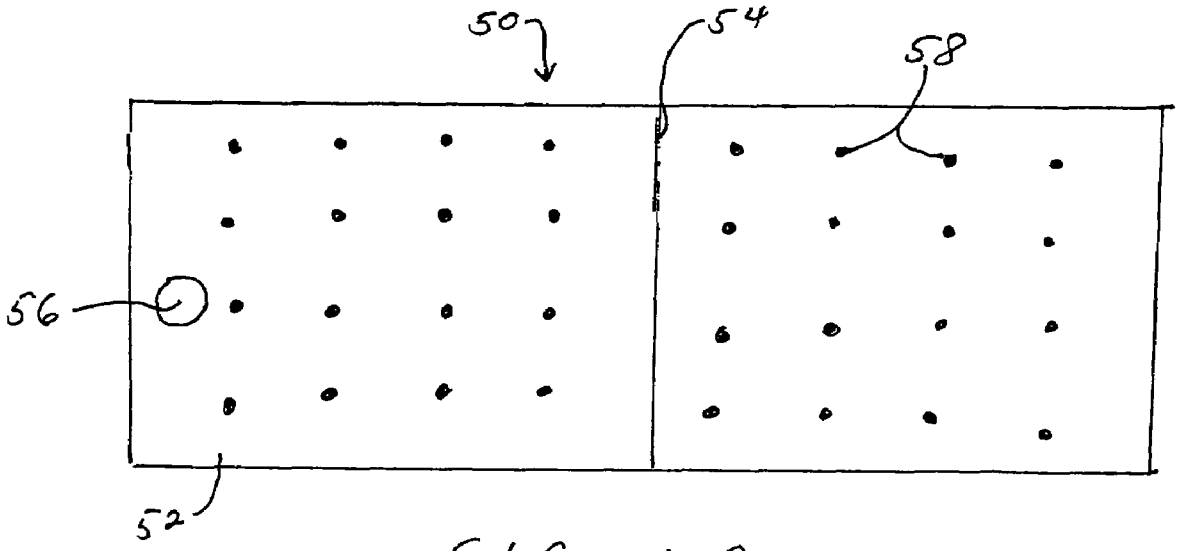
FIG. 12 is a top view of a piece holder for a chess set according to the present invention.

FIG. 7 shows a similar arrangement for a knight, where the ridge extends only partially around the periphery of the projection in two sections. Similarly, FIG. 8 shows a rook which extends around the periphery in four sections. FIGS. 9-11 show side views of the arrangement of the peripheries for bishops, queens and kings, respectively. In FIG. 9, the bishop has a periphery which slopes to a peak on each side. The queen piece is shown in FIG. 10 as having a periphery with a wavy pattern. FIG. 11 shows the end of the projection of the king piece which has a jagged periphery which is similar to the crown on the top of the king piece. For pieces of the opposite color, a central peg can also be added in similar fashion to FIG. 6.

While FIGS. 3-11 show one possible arrangement of projections which can be easily felt, other possible arrangements could also be used. This could include Braille or other tactile indicia marked on the projection. Other shapes can also be utilized as long as they are easily identifiable by feel. The two colors can also be identified by different arrangements, either by indicia, or by other types of projections or textures which identify the different colors of pieces.

While the holes 24 and the projections 40 can be simple cylindrical holes and pegs, it is possible to have a shape which is asymmetrical so that the piece is always aligned in the same direction. This will make the indicia or pattern on the projection more easily identifiable. For example, the hole and peg can be egg-shaped so that it will only fit in one direction. Also, it is possible to have a cylindrical shape, but with a key and keyhole arrangement, or one flattened side, so that only one orientation is possible. It is also possible to have a cylindrical peg with only part of the peg in the vertical direction being asymmetrical to accomplish the same purpose.

The preferred manner of the chess set is to provide two boards, one for each player with two complete sets of pieces. Thus, each player can hold his board in his hand so that the bottom of the board can be felt to take advantage of the lines which are provided thereon. The board may be of any size, although a size which is smaller than the standard size board is preferable so it would be easier to hold. However, the board should not be so small that the pieces are hard to identify. Thus, a size of about 5 inches on a side may be used.

It would also be possible for a single board to be used with the board being held by a stand so that it is accessible from underneath. The board could be gripped from the side by the stand, or it could be a stand with a surface for holding the border of the board with the central portion being open. Such a stand could be self-supporting or could rest on a standard table. By using a single board version, it is possible that the set can be used by players who are both deaf and blind.

It is also possible to have a piece holder for the chess set. That is, when various pieces are captured, they are removed from the board. While it is possible to merely place the pieces loose in any container, it is preferable to have a piece holder which is designed for the set so that the projections will not be broken and the pieces will not be lost. Such a piece holder 50 is shown as being made from a piece of solid material 52 such as plastic or wood. Alternatively, the material can be hollow if desired. A number of holes 58 are formed in the holder of a size similar to holes 24 on the board. Thus, it is possible to place the projections on the bottom of the chess pieces within the holes so that the pieces are maintained on the holder. If desired, a dividing line 54 may be placed in the middle of the holder to distinguish the locations for the white and black players. Although not shown, it would also be possible to include indicia on each side to indicate both visually and in Braille which side is for white pieces and which side for black pieces.

The holder also includes a hole 56 if desired. This hole is to receive a lanyard so that it is possible to have the piece holder hung either around the neck of the player or on a wrist. It would be possible for the lanyard to have a tightener so that the lanyard would fit either a neck or wrist. If the chess set is designed as a standard size board, it may be preferable to eliminate the lanyard in hole 56 and merely have the piece holder setting flat on the table on which the board is placed. The arrangement of the holes 58 on the material 52 can be varied as desired, depending on the size and shape of the holder. For holders which are mounted on a lanyard, it would be possible to have the white pieces on one surface and the black pieces on an opposite surface. It is also noted that the use of the lanyard may be preferable for small sets, such as those which are hand-held. For a two board set, it would be desirable to include two piece holders, with each player using one of the holders.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed:

1. A chessboard comprising:

a top surface having alternating squares of two colors, where the squares of one color are tactilely distinguishable from the other, each square having a hole for receiving a chess piece; and a bottom surface, said holes extending from the top surface through the bottom surface, said holes being connected by tactile lines, extending in at least one of the horizontal, vertical and diagonal directions.

2. The chessboard according to claim 1, further comprising indicia for indicating rank and file of the squares.

3. The chessboard according to claim 2, wherein the indicia is visual.

4. The chessboard according to claim 2, wherein the indicia is tactile.

5. The chessboard according to claim 2, wherein the indicia is on the bottom surface.

6. The chessboard according to claim 1, wherein the tactile lines extend in the horizontal, vertical and diagonal directions.

7. A chess set for use by blind players, comprising:

a chessboard having a top surface and a bottom surface, said top surface having alternating squares of different colors which are tactilely distinguishable, each square having a hole which extends from said top surface to a bottom surface of said board, said bottom surface having tactilely distinguishable lines extending in at least one of horizontal, vertical and diagonal directions joining said holes;

a plurality of chess pieces, each piece having an upper portion having a shape indicating the type of piece and a protrusion for extending through said holes, each protrusion extendable below said bottom surface of said chessboard and carrying an indication of the color and type of the upper part of piece which is distinguishable by feel.

8. The chess set according to claim 7, wherein said chessboard includes indicia on said bottom surface identifying rank and file by feel.

9. The chess set according to claim 7, wherein each protrusion includes an end having a center depression and a ridge indicating the type of piece.

10. The chess set according to claim 9, wherein the pieces of one color are distinguishable by a protrusion in the center of the depression.

11. The chess set according to claim 7, wherein the protrusions and holes are asymmetrical.

12. The chess set according to claim 7, wherein the protrusions and holes are symmetrical.

13. The chess set according to claim 7, wherein the chessboard is placed on a stand so that the bottom surface can be felt by each player.

14. The chess set according to claim 7, further comprising a piece holder for holding said plurality of said chess pieces having holes for receiving said protrusions.

15. A chess set comprising two chessboards and two sets of chess pieces;

each chessboard having squares, of two colors which are tactilely distinguishable with a hole in each square which extends from a top surface to a bottom surface of said chessboard, said bottom surface containing tactile lines extending between said holes in at least one of horizontal, vertical or diagonal directions;

each piece of each set of pieces having an upper portion having a shape indicating the type of piece and a protrusion which extends through said holes and extends below said bottom surface of said chessboard, said protrusion containing a tactilely distinguishable indication of the color and type of the upper part of the piece.

16. The chess set according to claim 15, wherein at least one of said boards contains tactile indicia indicating rank and file.

17. The chess set according to claim 16, wherein the indicia are present on the bottom surface.

18. The chess set according to claim 15, wherein the protrusion contains a central depression with a ridge for indicating the type of piece.

19. The chess set according to claim 18, wherein a protrusion is present in said depression in pieces of one color.

20. The chess set according to claim 15, further comprising a piece holder for holding said plurality of said chess pieces having holes for receiving said protrusions.

21. A chess piece for a chess set comprising:

an upper part having a shape indicating the type of piece; and a lower protrusion for extending through a hole in a chessboard, said protrusion carrying a tactile indication of the type and color of the upper part of the piece, wherein the protrusion is a cylindrical peg with an end having a central depression and a ridge having a shape indicative of the type of piece has been.

* * * * *